US009693148B1

(12) United States Patent
Lopez

(10) Patent No.: US 9,693,148 B1
(45) Date of Patent: Jun. 27, 2017

(54) ACOUSTIC HAILING DEVICE

(71) Applicant: LRAD Corporation, San Diego, CA (US)

(72) Inventor: Hernan Lopez, San Diego, CA (US)

(73) Assignee: LRAD Corporation, San Diego, CA (US)

( * ) Notice: Subject to any disclaimer, the term of this patent is extended or adjusted under 35 U.S.C. 154(b) by 155 days.

(21) Appl. No.: 14/822,579

(22) Filed: Aug. 10, 2015

Related U.S. Application Data

(60) Provisional application No. 62/035,199, filed on Aug. 8, 2014.

(51) Int. Cl.

| | |
|---|---|
| ***H04R 25/00*** | (2006.01) |
| ***H04R 13/00*** | (2006.01) |
| ***H04R 1/02*** | (2006.01) |
| ***H04R 1/40*** | (2006.01) |
| ***G10K 11/26*** | (2006.01) |

(52) U.S. Cl.
CPC ..... *H04R 13/00* (2013.01); *G10K 11/26* (2013.01); *H04R 1/023* (2013.01); *H04R 1/403* (2013.01); *H04R 2400/13* (2013.01)

(58) Field of Classification Search
CPC .... H04R 2201/34; H04R 1/30; H04R 1/2865; H04R 1/2861; H04R 1/345; H04R 1/403; H04R 2201/10; H04R 2400/13; G10K 11/26
USPC ..... 381/340, 342, 343
See application file for complete search history.

(56) References Cited

U.S. PATENT DOCUMENTS

| | | | | |
|---|---|---|---|---|
| 4,349,084 | A * | 9/1982 | Karpodines | H04R 1/2819 181/146 |
| 4,836,327 | A * | 6/1989 | Andrews | H04R 1/30 181/145 |
| 5,115,882 | A * | 5/1992 | Woody | H04R 1/345 181/144 |
| 5,146,508 | A | 9/1992 | Bader et al. | |
| 5,253,301 | A * | 10/1993 | Sakamoto | H04R 1/2826 181/145 |
| 5,872,339 | A * | 2/1999 | Hanson | H04R 1/26 181/144 |
| 5,878,148 | A | 3/1999 | Alexandrov | |
| 6,320,970 | B1 | 11/2001 | Czerwinski et al. | |
| 9,245,513 | B1 * | 1/2016 | Dimitrov | H04R 1/345 |
| 2002/0066270 | A1 * | 6/2002 | Rouse | F01K 23/10 60/670 |
| 2004/0136560 | A1 * | 7/2004 | Walsh | H04R 9/06 381/401 |

(Continued)

*Primary Examiner* — Davetta W Goins
*Assistant Examiner* — Phylesha Dabney
(74) *Attorney, Agent, or Firm* — Thorpe North & Western, LLP

(57) ABSTRACT

An acoustic hailing device includes an outer housing and a pair of compression drivers oriented in the outer housing adjacent one another. Each of the compression drivers includes two diaphragms oriented facewise relative to one another within each compression driver. One or more waveguide housings are coupled to the outer housing, the one or more waveguide housings forming a portion of a waveguide associated with each of the compression drivers. A pair of driver covers are each coupleable to one of the compression drivers, each of the driver covers forming another portion of the waveguide associated with each of the compression drivers.

20 Claims, 7 Drawing Sheets

(56) References Cited

U.S. PATENT DOCUMENTS

| | | | | |
|---|---|---|---|---|
| 2005/0111673 | A1* | 5/2005 | Rosen | B60R 11/0217 381/89 |
| 2006/0285712 | A1* | 12/2006 | Butler | H04R 1/24 381/340 |
| 2008/0239876 | A1 | 10/2008 | Norris et al. | |
| 2009/0310809 | A1* | 12/2009 | Voishvillo | H04R 1/30 381/343 |
| 2011/0085692 | A1* | 4/2011 | Voishvillo | H04R 1/30 381/343 |
| 2013/0094677 | A1* | 4/2013 | Stude | H04R 1/24 381/182 |
| 2015/0319515 | A1* | 11/2015 | Devantier | H04R 1/021 381/345 |
| 2015/0341710 | A1* | 11/2015 | Gladwin | H04R 1/00 381/152 |
| 2015/0373445 | A1* | 12/2015 | Voishvillo | H04R 1/30 381/150 |
| 2016/0037258 | A1* | 2/2016 | Wilkes, Jr. | H04R 5/02 381/307 |
| 2016/0105744 | A1* | 4/2016 | Voishvillo | H04R 1/30 381/343 |
| 2017/0055067 | A1* | 2/2017 | Moro | H04R 1/2861 |

* cited by examiner

ACOUSTIC HAILING DEVICE

PRIORITY CLAIM

Priority is claimed of and to U.S. Provisional Patent Application Ser. No. 62/035,199, filed Aug. 8, 2014, which is hereby incorporated herein by reference in its entirety.

BACKGROUND OF THE INVENTION

Field of the Invention

The present invention relates generally to acoustic hailing systems.

Related Art

Drivers that convert an electrical signal into acoustical energy or sound waves in order to radiate the sound waves into air have been used for some time. Such devices include direct radiators, which directly radiate the generated sound waves, and indirect radiators, which utilize additional elements for radiating the generated sound waves. In a direct radiator, a diaphragm directly vibrates or moves the surrounding air and generates the sound waves related to the electrical signal. In an indirect radiator, the diaphragm moves against a surface closely spaced thereto and generates high pressure compression waves which are passed through a throat and to a horn or other acoustic generator having a smaller upstream area than the diaphragm. Generally, indirect radiators, such as compression drivers, can generate much higher audible levels when compared with direct radiators and are used, for example, in public address systems.

SUMMARY OF THE INVENTION

In accordance with one embodiment of the invention, an acoustic hailing device is provided, including an outer housing and a pair of compression drivers oriented in the outer housing adjacent one another. Each of the compression drivers can include two diaphragms oriented facewise relative to one another within each compression driver. One or more waveguide housings can be coupled to the outer housing, the one or more waveguide housings forming a portion of a waveguide associated with each of the compression drivers. A pair of driver covers can each be coupleable to one of the compression drivers. Each of the driver covers can form another portion of the waveguide associated with each of the compression drivers.

In accordance with another aspect of the invention, an acoustic hailing device is provided, including a portable outer housing and a pair of compression drivers oriented in the outer housing adjacent one another. Each of the compression drivers can include two diaphragms oriented facewise relative to one another within each compression driver. One or more waveguide housings can be coupled to the outer housing, the one or more waveguide housings forming a portion of a waveguide associated with each of the compression drivers. A pair of driver covers can each be coupleable to one of the compression drivers, each of the driver covers forming another portion of the waveguide associated with each of the compression drivers.

One or more amplifiers can be electronically coupled to each compression driver. The one or more amplifiers and all control electronics associated with the device can be contained within the outer housing in an environmentally sealed condition such that the portable device is substantially watertight.

In accordance with another aspect of the invention, a method of generating an audible signal is provided, including: providing an electronic signal to one or more amplifiers; directing an amplified signal to each of a pair of compression drivers, the pair of compression drivers being oriented adjacent one another in an outer housing; exciting, with the amplified signal, each of a pair of diaphragms oriented facewise relative to one another within each of the pair of compression drivers; and directing sound waves generated by the pair of diaphragms through individual sound ducts within each of the pair of compression drivers, the individual sound ducts being oriented in opposing directions immediately adjacent the diaphragms and being oriented in a common direction in a location at which a generated audible verbal hailing command exits the compression drivers.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

The following drawings illustrate exemplary embodiments for carrying out the invention. Like reference numerals refer to like parts in different views or embodiments of the present invention in the drawings.

DETAILED DESCRIPTION

Figure 1:
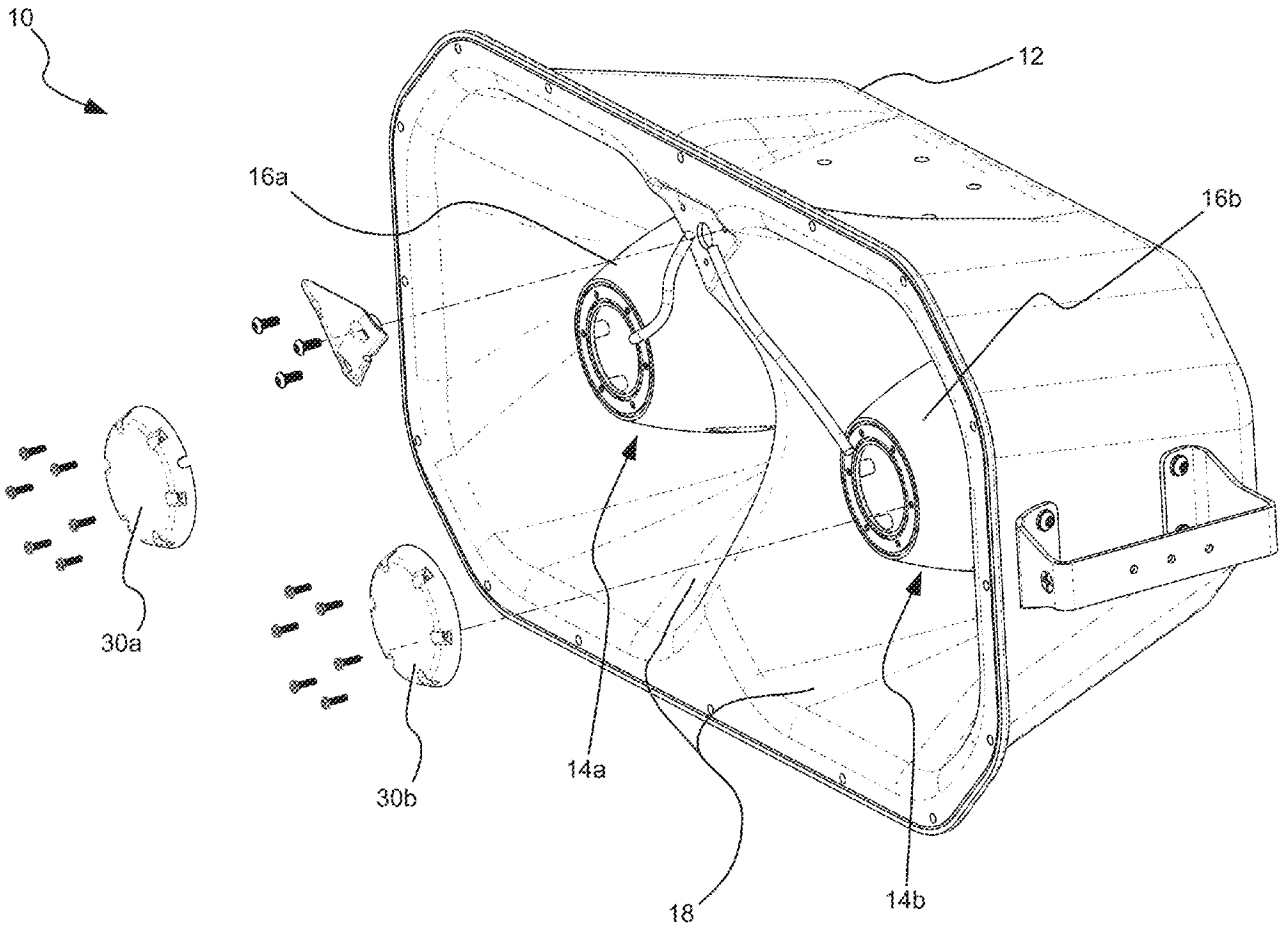
FIG. 1 is a perspective, partially exploded view of an acoustic hailing device in accordance with one aspect of the technology.

Before the present invention is disclosed and described, it should be understood that this invention is not limited to the particular structures, process steps, or materials disclosed herein, but is extended to equivalents thereof as would be recognized by those of ordinarily skill in the relevant arts. It should also be understood that terminology employed herein is used for the purpose of describing particular embodiments only and is not intended to be limiting in any way.

It must be noted that, as used in this specification and the appended claims, the singular forms "a" and "the" include plural referents, unless the context clearly dictates otherwise. Thus, for example, reference to a "driver" can, but does not necessarily, include one or more of such drivers.

DEFINITIONS

In describing and claiming the present invention, the following terminology will be used in accordance with the definitions set forth below.

As used herein, the term "substantially" refers to the complete or nearly complete extent or degree of an action, characteristic, property, state, structure, item, or result. As an arbitrary example, an object that is "substantially" enclosed is an article that is either completely enclosed or nearly completely enclosed. The exact allowable degree of deviation from absolute completeness may in some cases depend upon the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. As another arbitrary example, a composition that is "substantially free of" an ingredient or element may still actually contain such item so long as there is no measurable effect as a result thereof.

As used herein, the term "about" is used to provide flexibility to a numerical range endpoint by providing that a given value may be "a little above" or "a little below" the endpoint.

Relative directional terms are sometimes used herein to describe and claim various components of the ride systems of the present invention. Such terms include, without limitation, "upward," "downward," "horizontal," "vertical," etc. These terms are generally not intended to be limiting, but are used to most clearly describe and claim the various features of the invention. Where such terms must carry some limitation, they are intended to be limited to usage commonly known and understood by those of ordinary skill in the art.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

The Invention

The present invention is directed to an acoustic hailing device that provides superior power density and efficiency relative to conventional systems. The system allows for increased power handling and increased total output of the device without requiring a corresponding increase in the total number of acoustic drivers. The present system can thus provide these advantages in output and efficiency without requiring an increase in an overall size of the system.

While not necessarily so limited, the present technology is well suited to hailing applications, in which verbal commands are directed to listeners from afar. In such applications, the ability to clearly communicate verbal commands at high volume outputs is particularly advantageous. In addition, the present technology provides such technology in a small form-factor, ruggedized, water resistant package having an integrated amplifier. This, coupled with the pairing of dual-diaphragm drivers in a single unit, provides a compact system that can be deployed in a variety of environments, even very harsh environments.

While the overall size of the system can vary, in one embodiment the system can be as small as twenty-eight inches in width, fourteen inches in height, and twelve inches in depth. The system can weigh less than about 40 pounds. Thus, it is easily portable, and can be deployed in a variety of locations (e.g., ground level, vehicle mounted, aerial mounts, etc.). The system can be completely self-sustained, requiring only an input signal and a power supply.

Figure 2:
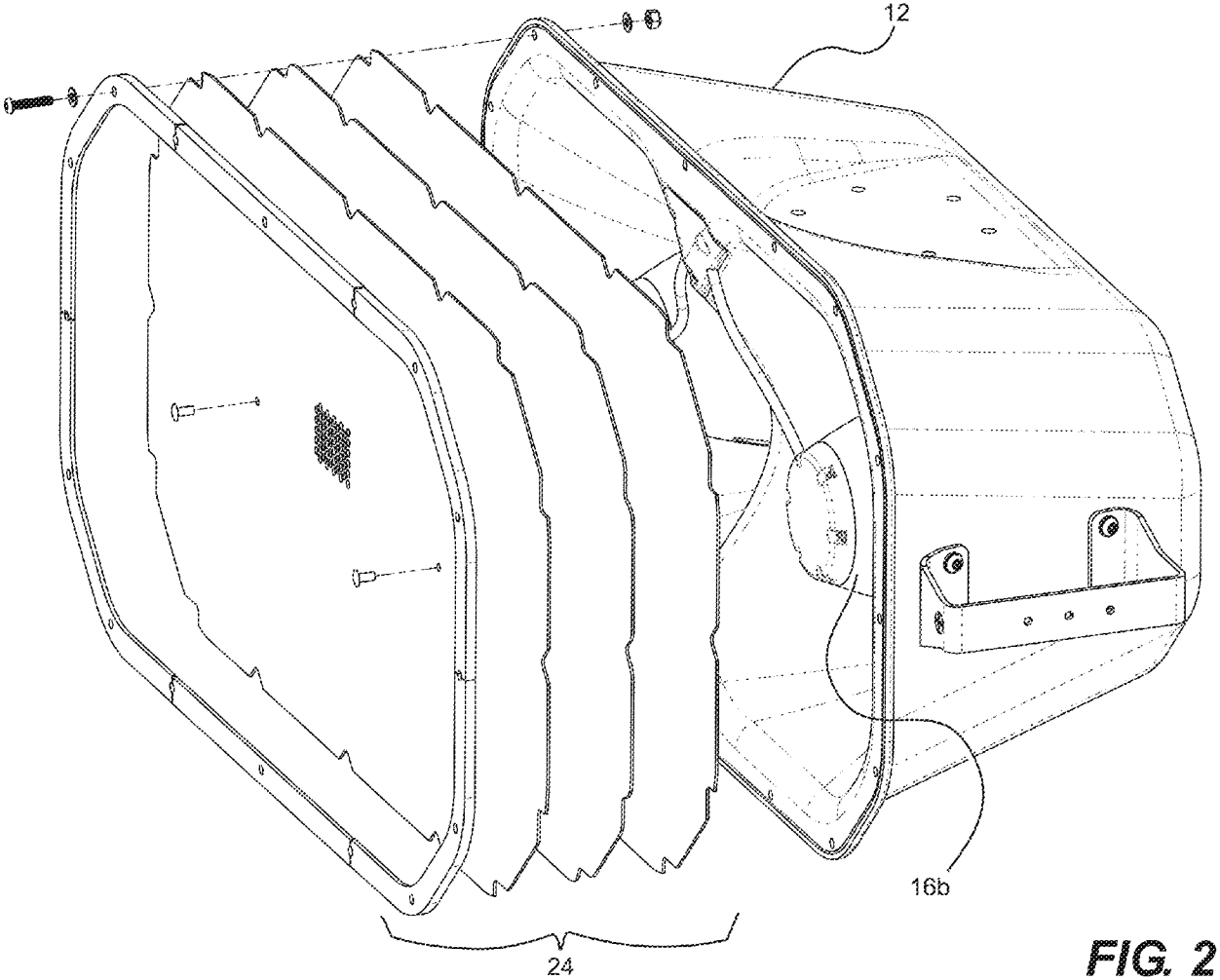
FIG. 2 is another partially exploded view of the device of FIG. 1.
Figure 3:
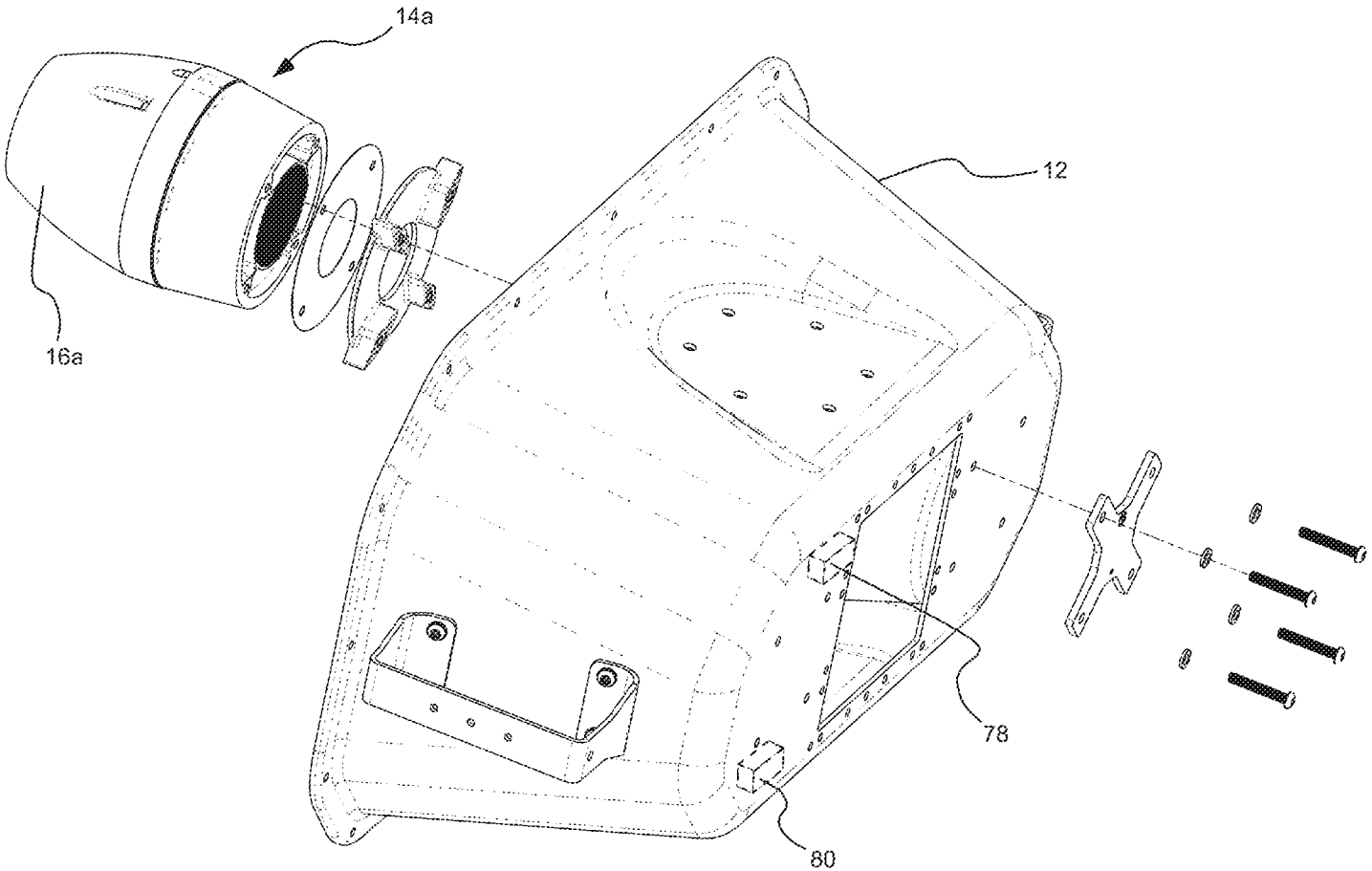
FIG. 3 is another partially exploded view of the device of FIG. 1.

As shown generally in the figures, with particular reference to FIGS. 1-3, the system 10 can include an outer housing 12, sized to be readily portable and used in a variety of applications and environments. A pair of compression drivers 14*a*, 14*b* can be positioned within the outer housing adjacent one another, in a side-by-side configuration. One or more waveguide housings 18 can be provided to guide the acoustic output of each of the drivers. The waveguide housing can be a single unit with dedicated paths for each driver, or individual waveguides, one for each driver. In either case, the waveguide housing provides at least a portion of a waveguide for each driver.

Each of the compression drivers 14*a*, 14*b* can include a driver cover 16*a*, 16*b*, respectively, which can each include a driver cap 30*a*, 30*b*, respectively. The shape of the driver covers can be carefully controlled so as to both provide protection for the driver, and to form a useful portion of the waveguide for that driver. In other words, the inner portion of the waveguide for each driver is provided by the protective cover of each driver. The inside of the waveguide housing and the outside of the driver collectively define a waveguide to produce a highly directional sound pattern.

The present system provides increased output relative to conventional two-driver systems by utilizing drivers that include a pair of diaphragms (and associated voicecoils) instead of a single diaphragm. Two dual-diaphragm drivers can be used in a unique configuration, designed to fit within a waveguide housing ordinarily used with single diaphragm drivers. The outer envelope of the double diaphragm drivers can thus be maintained consistent with that of the single diaphragm drivers.

This configuration allows for increased power handling and increased total output of the acoustic hailing device without increasing the total number of drivers. Previous designs with single diaphragm drivers required the addition of individual drivers to the system in order to increase the total sound output. This required the size of the housing to be increased to fit the additional drivers. The present system achieves the increase in power output without increasing the number of individual drivers. In one aspect, only two compression drivers, positioned side-by-side within the outer housing 12, are necessary to provide the desired output. Each of these compression drivers can be provided with a pair of diaphragms, as discussed in more detail below.

Figure 4:
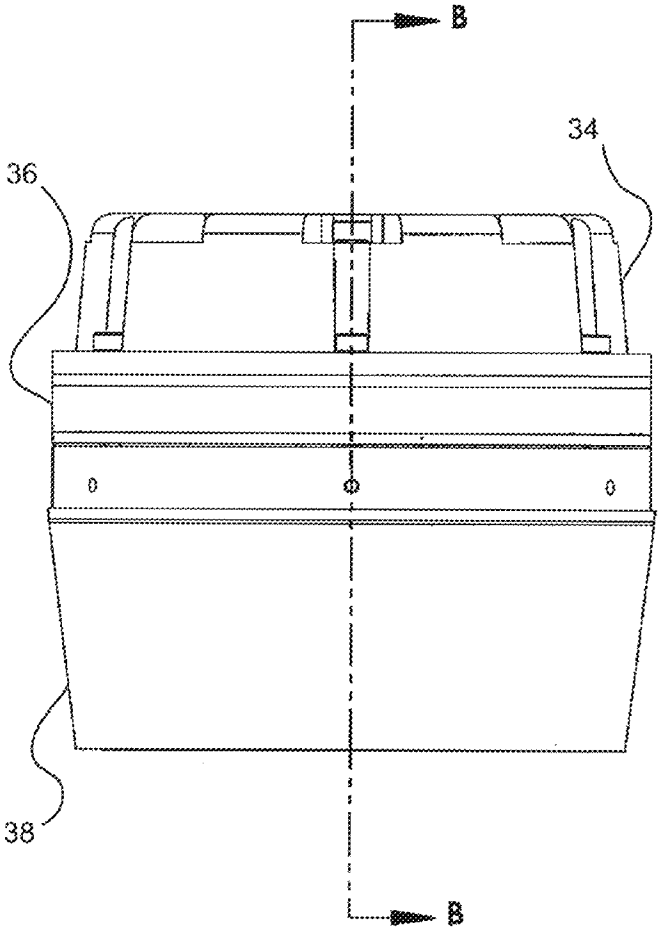
FIG. 4 is a side view of a compression driver in accordance with an aspect of the technology.
Figure 4B:
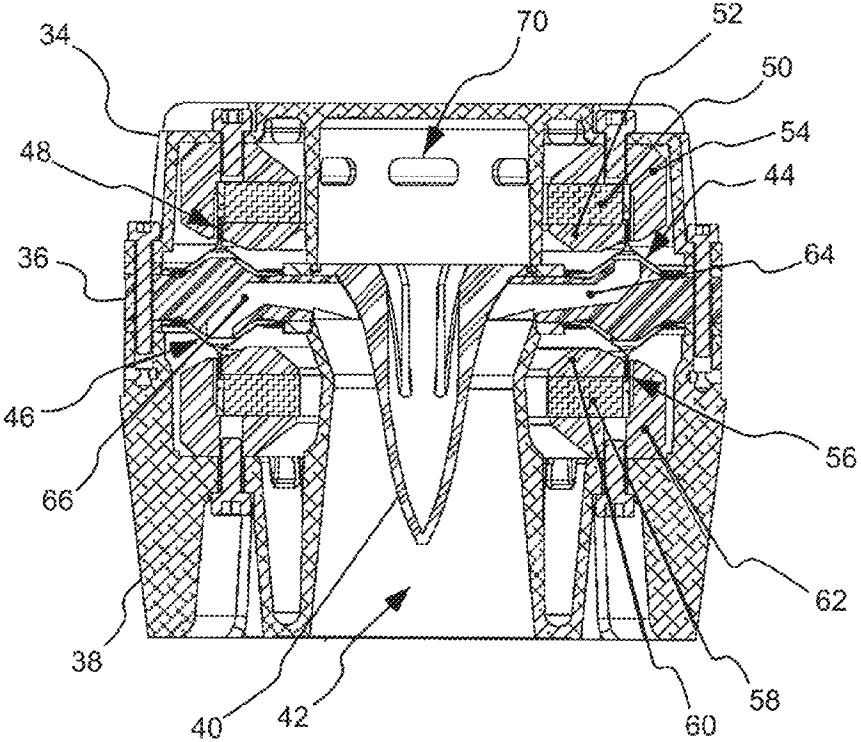
FIG. 4B is a sectional view of the compression driver of FIG. 4, taken through section B-B of FIG. 4.
Figure 6:
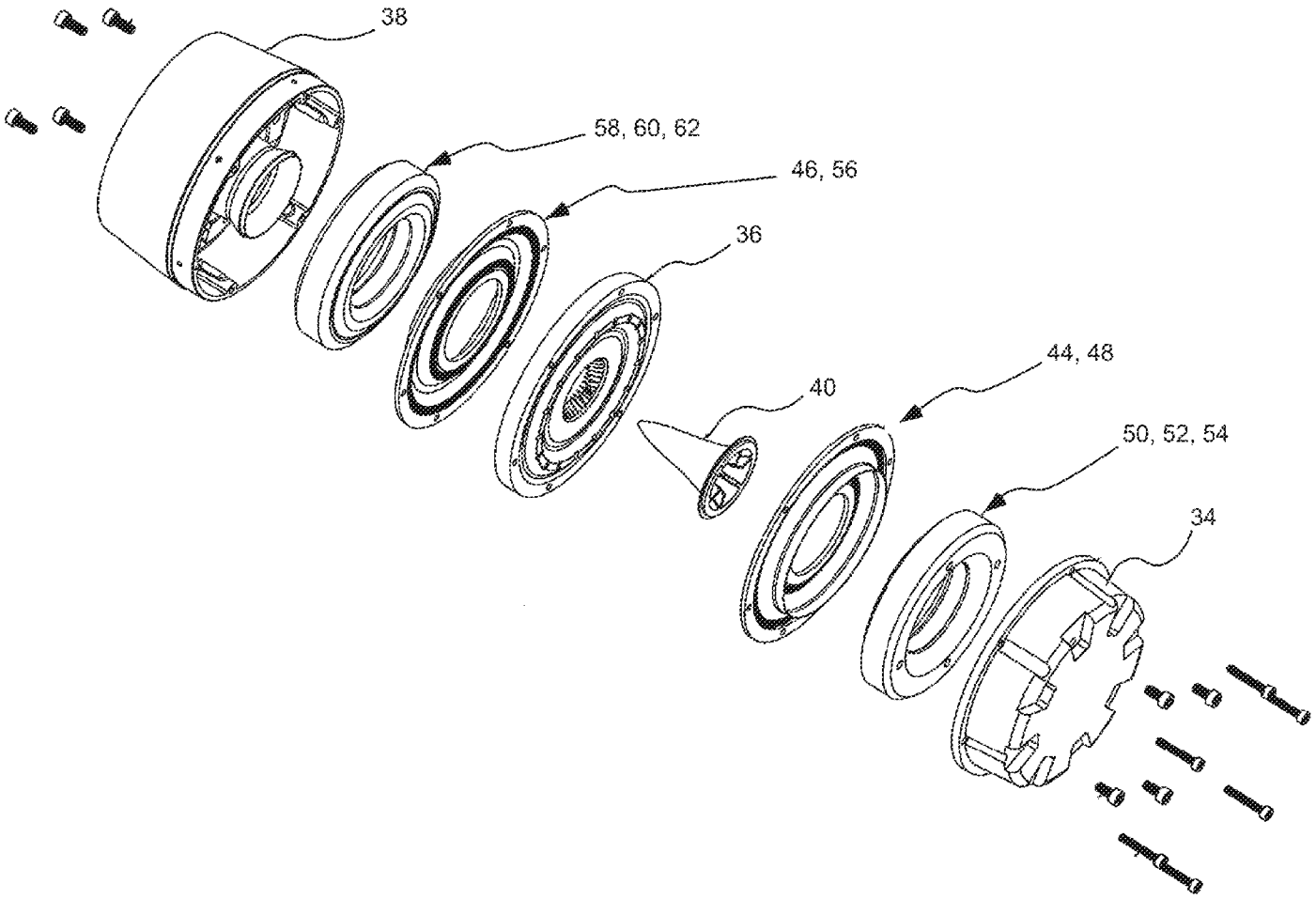
FIG. 6 is an exploded view of the compression driver of FIG. 4.

Turning now to FIGS. 4 and 4B, an exemplary compression driver 14 is illustrated in accordance with one aspect of the technology. FIG. 6 also illustrates these components shown in a partially exploded view. The driver can include an upper driver housing 34, a phase duct housing 36 and a lower driver housing 38. A phase plug 40 can be provided that extends into driver throat 42. An upper diaphragm 44 can be provided, along with lower diaphragm 46. The upper and lower diaphragms can be positioned facewise relative to one. While the upper and lower diaphragms face each other, they initially direct sound waves in opposing directions, as discussed in more detail below.

Each of the upper 44 and lower 46 diaphragms can include independent voicecoils and magnets. For example, upper diaphragm can include an upper voicecoil 48 and an upper magnet 50 that can include inner magnet structure 52 and outer magnet structure 54. The lower diaphragm can include lower voicecoil 56 and a lower magnet 58 that can include inner magnet structure 60 and outer magnet structure 62. Vents 70 can connect an inner cavity to an outer cavity.

The upper diaphragm 44 can initially direct sound waves downwardly into upper sound duct 64, while the lower diaphragm 46 can initially direct sound waves upwardly into lower sound duct 66. Thus, the initial output from each diaphragm is toward each other, in opposite directions. However, the sound ducts 64, 66 are arranged such the sound waves are redirected downwardly (relative to FIG. 4) to exit the driver together. In one aspect, the lengths of the upper 64 and lower 66 sound ducts can be the same (that is, the sound pathway for each diaphragm is the same). In this manner, the audio produced by the two diaphragms can be in phase as the audio is directed from the driver.

Figure 5:
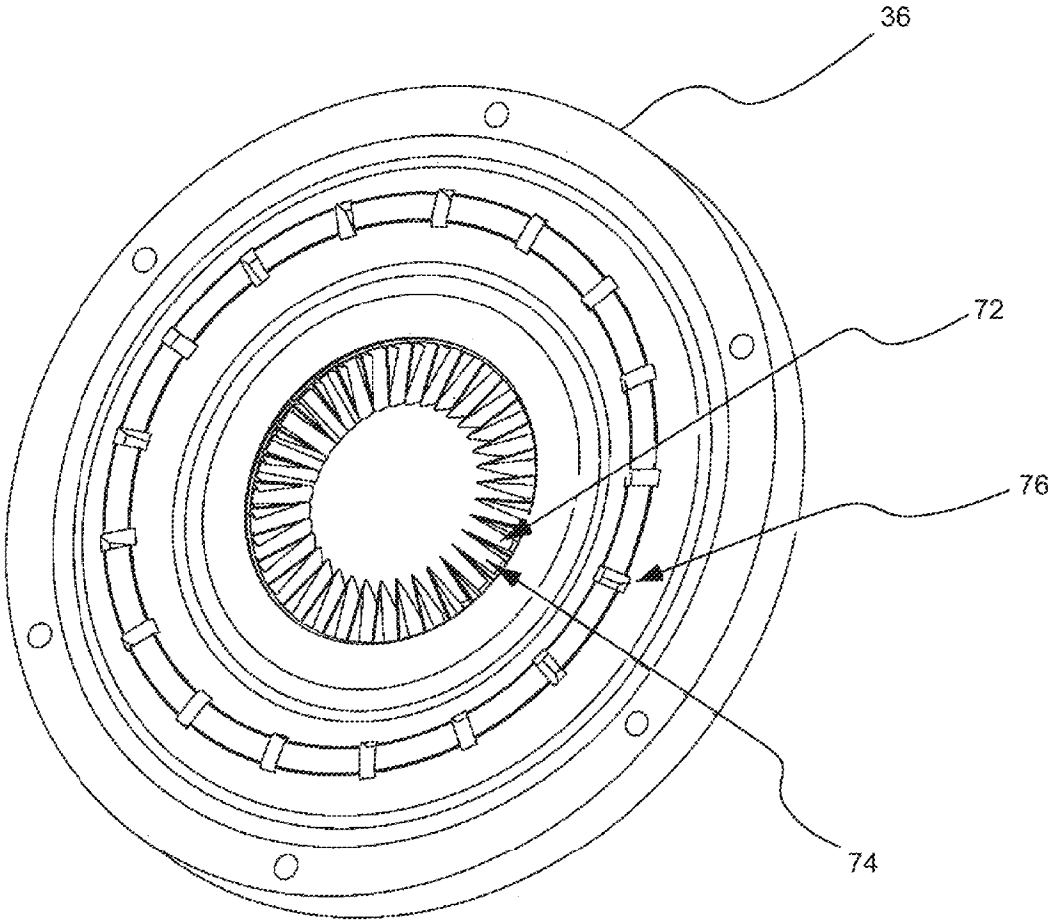
FIG. 5 is a perspective view of a phase duct housing of the compression driver of FIG. 4.

FIG. 5 illustrates the phase duct housing 36 in more detail. In this view, the audio output is directed out of the page. One exemplary sound entry aperture for one of the diaphragms is shown at 76. The audio exits through one or more exit apertures 72, 74. As is shown, exit apertures 72, 74 are oriented immediately adjacent one another. Each, however, provides an exit path for only one of the sound ducts 64, 66. For example, exit duct 72 can provide an exit path for sound traveling through duct 64 (which carries sound produced by diaphragm 44). Exit duct 74 can provide an exit path for sound traveling through duct 66 (which caries sound produced by diaphragm 46). Thus, sound is exiting from every other aperture from each respective sound duct.

The present technology thus allows two ring diaphragms to be incorporated into a compression driver that would previously have only contained one diaphragm. This allows the compression driver to run at twice the power input as a single diaphragm driver, resulting in an increase in Sound Pressure Level (SPL). In addition, the increase in diaphragm area results in an increase in SPL. This doubling of both input power and diaphragm area results in a theoretical 6 Decibel increase in SPL compared to a single diaphragm compression driver.

The design accomplishes this in part by orienting the diaphragms face-to-face and then providing ducting so that the output from each diaphragm is interleaved or interwoven, allowing the sound ducts to terminate at the same location. This allows the path of each individual duct from one diaphragm to be the same length as a corresponding duct from the other diaphragm (within the same driver). By maintaining equal path lengths, the sound wave fronts arrive coincidently from each diaphragm. This coincident wave front arrival allows the maximum SPL to be achieved.

The dual diaphragm drivers are designed to fit in the same waveguide housings as single diaphragm drivers by maintaining the outer envelope of the double diaphragm drivers consistent with that of the single diaphragm drivers. This arrangement of dual diaphragm drivers allows for increased power handling and increased total output without increasing the total number of drivers. Previous designs with single diaphragm drivers required the addition of drivers (that is, a larger array of drivers) to the system in order to increase the total sound output.

Figure 7:
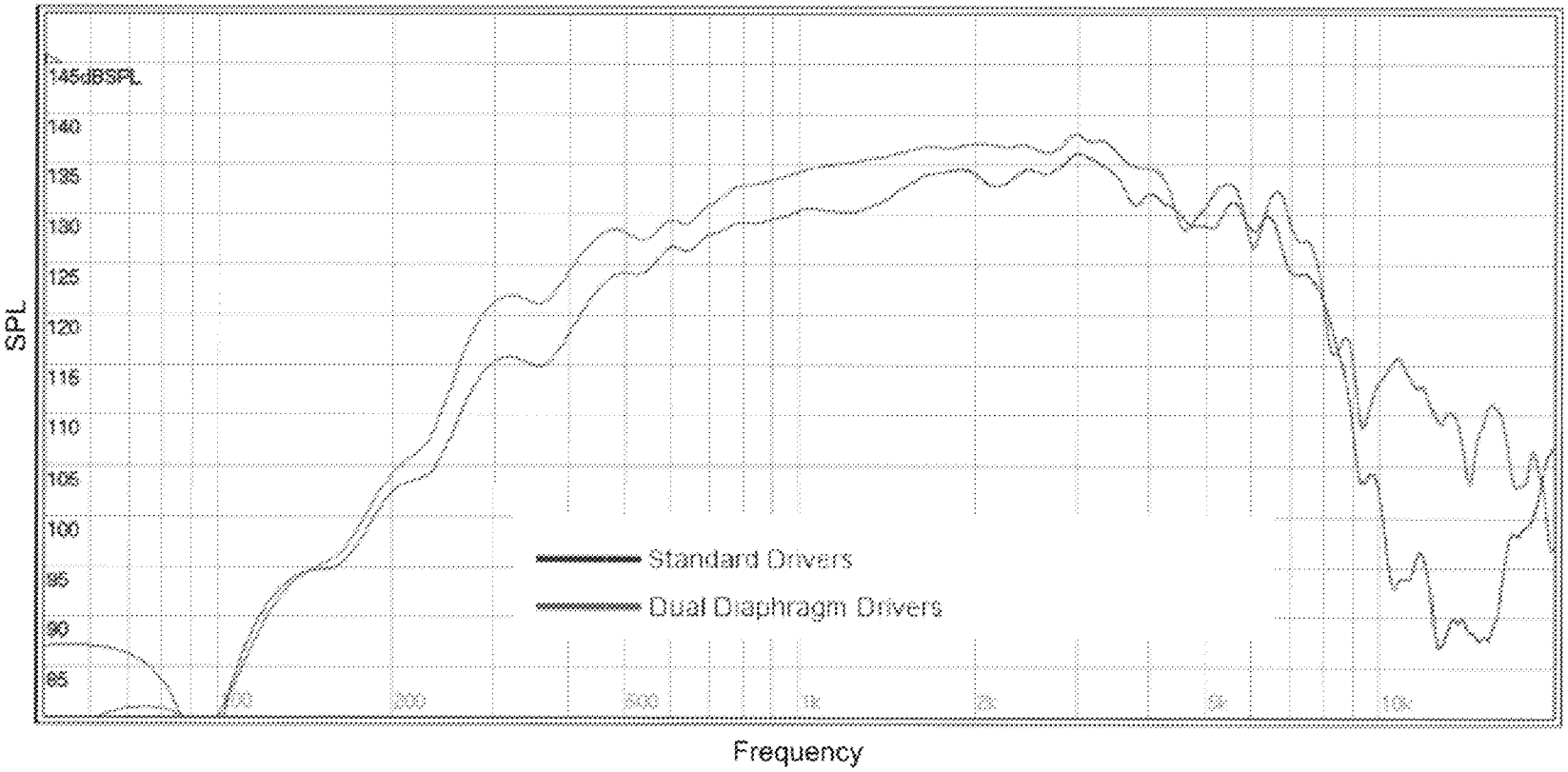
FIG. 7 is a frequency response plot comparing SPL output of a conventional system to the present system.

As shown in FIG. 7, the present dual diaphragm driver configuration has improved sensitivity over the lower range of the frequency response curve, resulting in up to 4 dB of increased SPL. The following Table A illustrates the output (SPL) of the present system compared to conventional systems at various frequencies:

TABLE A

| | 500 Hz. | 1.0 kHz. | 1.5 kHz | 2.0 kHz | 2.5 kHz | 3.0 kHz |
|---|---|---|---|---|---|---|
| Std. drivers | 124.2 | 130.4 | 132.6 | 134.0 | 134.5 | 136.1 |
| Dual diaphragm drivers | 128.2 | 134.2 | 136.2 | 137.1 | 136.7 | 138.0 |

The outer housing 12 can contain an acoustic amplifier (shown schematically and for exemplary purposes at 78 in FIG. 3) and control electronics (also shown schematically and for exemplary purposes at 80 in FIG. 3). Each of these components can be contained within the outer housing in an environmentally protected enclosure. In this manner, the entire device can be maintained in an environmentally sealed condition. Inputs for power and input signal can be provided via conventional coupling interfaces, through watertight input plugs and the like.

In addition, each of the compression drivers 14 can include a moisture barrier or membrane positioned at a throat thereof. The moisture barrier can prevent moisture from entering the compression driver but can also allow sound to pass from the compression driver. A protective screen system (24 in FIG. 2) can be provided to protect the drivers and driver covers from the environment in which the hailing device will be utilized. In this manner, the entire hailing device can be provided as a watertight enclosure. This is accomplished with the present technology without detracting from the enhanced audio output and efficiency provided.

In addition to the structure shown and described herein, the present technology also provides various methods of manufacturing hailing devices, of producing acoustic output with compression drivers, and of hailing individuals. In one particular example, a method of generating an audible signal is provided, including providing an electronic signal to one or more amplifiers and directing an amplified signal to each of a pair of compression drivers, the pair of compression drivers being oriented adjacent one another in an outer housing. The amplified signal can be used to excite each of a pair of diaphragms oriented facewise relative to one another within each of the pair of compression drivers. Sound waves generated by the pair of diaphragms can be directed through individual sound ducts within each of the pair of compression drivers, the individual sound ducts being oriented in opposing directions immediately adjacent the diaphragms and being oriented in a common direction in a location at which a generated audible verbal hailing command exits the compression drivers.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. An acoustic hailing device, comprising:

an outer housing;

a pair of compression drivers oriented in the outer housing adjacent one another, each of the compression drivers including two diaphragms oriented facewise relative to one another within each compression driver;

one or more waveguide housings, coupled to the outer housing, the one or more waveguide housings forming a portion of a waveguide associated with each of the compression drivers; and a pair of driver covers, each coupleable to one of the compression drivers, each of the driver covers forming another portion of the waveguide associated with each of the compression drivers.

2. The device of claim 1, wherein the pair of compression drivers are the only compression drivers contained in the outer housing.

3. The device of claim 1, wherein each compression driver includes a sound wave duct for each diaphragm, and wherein a length of the sound wave duct for each diaphragm in each compression driver is substantially the same.

4. The device of claim 3, wherein the sound wave ducts for each of the diaphragms in each compression driver are interleaved or interwoven.

5. The device of claim 1, wherein the outer housing comprises a portable unit.

6. The device of claim 5, wherein all acoustic amplifier and control electronics associated with the device are contained within the outer housing in an environmentally sealed condition.

7. The device of claim 1, wherein each compression driver includes a moisture barrier positioned at a throat thereof, the moisture barrier preventing moisture from entering the compression driver but allowing sound to pass from the compression driver.

8. The device of claim 1, wherein each driver cover environmentally seals all electrical connections contained within the compression driver.

9. The device of claim 1, further comprising a protective screen coupled to the outer housing and covering each of the pair of compression drivers and driver covers.

10. An acoustic hailing device, comprising:

a portable outer housing;

a pair of compression drivers oriented in the outer housing adjacent one another, each of the compression drivers including two diaphragms oriented facewise relative to one another within each compression driver;

one or more waveguide housings, coupled to the outer housing, the one or more waveguide housings forming a portion of a waveguide associated with each of the compression drivers;

a pair of driver covers, each coupleable to one of the compression drivers, each of the driver covers forming another portion of the waveguide associated with each of the compression drivers; and one or more amplifiers electronically coupled to each compression driver; wherein:

the one or more amplifiers and all control electronics associated with the device are contained within the outer housing in an environmentally sealed condition such that the portable device is substantially watertight.

11. The device of claim 10, wherein the pair of compression drivers are the only compression drivers contained in the outer housing.

12. The device of claim 10, wherein each compression driver includes a sound wave duct for each diaphragm, and wherein a length of the sound wave duct for each diaphragm in each compression driver is substantially the same.

13. The device of claim 12, wherein the sound wave duct for each of the diaphragms in each compression driver are interleaved or interwoven.

14. The device of claim 10, wherein each compression driver includes a moisture barrier positioned at a throat thereof, the moisture barrier preventing moisture from entering the compression driver but allowing sound to pass from the compression driver.

15. The device of claim 10, wherein each driver cover environmentally seals all electrical connections contained within the compression driver.

16. A method of generating an audible signal, comprising:

providing an electronic signal to one or more amplifiers;

directing an amplified signal to each of a pair of compression drivers, the pair of compression drivers being oriented adjacent one another in an outer housing;

exciting, with the amplified signal, each of a pair of diaphragms oriented facewise relative to one another within each of the pair of compression drivers;

directing sound waves generated by the pair of diaphragms through individual sound ducts within each of the pair of compression drivers, the individual sound ducts being oriented in opposing directions immediately adjacent the diaphragms and being oriented in a common direction in a location at which a generated audible verbal hailing command exits the compression drivers.

17. The method of claim 16, wherein the electronic signal carries a verbal hailing command.

18. The method of claim 16, wherein the ducts for each of the diaphragms in each compression driver are interleaved or interwoven.

19. The method of claim 18, wherein a length of the sound wave duct for each diaphragm in each compression driver is substantially the same.

20. The method of claim 16, wherein the outer housing is portable.

* * * * *